United States Patent [19]

von der Beck et al.

[11] 4,308,448

[45] Dec. 29, 1981

[54] HEATING CABLE WITH A SPECIFIC HEATING CAPACITY

[76] Inventors: Heinz von der Beck, Mozartring 18, 8011 Baldham; Volker Dietz, Gabelsbergerstrasse 17, 8 Munich 2, both of Fed. Rep. of Germany

[21] Appl. No.: 111,695

[22] Filed: Jan. 14, 1980

[30] Foreign Application Priority Data

Jan. 16, 1979 [DE] Fed. Rep. of Germany ..... 2901446

[51] Int. Cl.[3] ..... H05B 3/10

[52] U.S. Cl. ..... 219/552; 219/528; 219/541; 219/544; 219/548; 338/214

[58] Field of Search ..... 219/528, 529, 541, 544, 219/548, 549, 550, 552; 338/213, 214; 339/97 C

[56] References Cited

U.S. PATENT DOCUMENTS

| | | | |
|---|---|---|---|
| 2,494,589 | 1/1950 | Stetner | 338/214 X |
| 3,474,229 | 10/1969 | Rump | 219/552 |
| 3,757,086 | 9/1973 | Indoe | 219/528 |
| 4,037,083 | 7/1977 | Leavines | 219/552 |

FOREIGN PATENT DOCUMENTS

| | | | |
|---|---|---|---|
| 116448 | 10/1946 | Sweden | 338/214 |

*Primary Examiner*—Volodymyr Y. Mayewsky
*Attorney, Agent, or Firm*—Fishman and Van Kirk

[57] ABSTRACT

A heater cable with coaxial inner and outer conductors and an intermediately disposed resistance heater. The heater is spaced from the inner conductor by radially extending alternating conductive and non-conductive separators with current being delivered to the heater by the conductive separators. The heater is deformed so as to contact the outer conductor at spaced locations to thereby define plural parallel heating circuits.

12 Claims, 3 Drawing Figures

HEATING CABLE WITH A SPECIFIC HEATING CAPACITY

BACKGROUND OF THE INVENTION (1) Field of the Invention

This invention relates to a heating cable with a specific heating capacity for use in devices, applicances, structural parts, public squares, streets, etc.

(2) Description of the Prior Art

Heating cables are known which are single core or multi-core designs, and which generate heat energy by using electrical resistance wires. In addition, heating cables are also known in which at least two electrical conductors running essentially parallel are separated from one another by a resistance material, and in which this separator material exhibits fixed, specific electrical resistance values. Moreover, depending on where these heating cables are employed, said separator materials may be chosen so as to have either a positive or negative coefficient of resistance.

In the case of these known heating cables, cables with various resistance values must be available for different applications. Thus, the cables can be adapted first by means of selecting the length of the heating cable and secondly by means of using materials having different resistance values for the electrical wires or for the separator material. To adapt the cable in this manner, a compromise must always be struck since for economic reasons only a limited number of heating cables with different resistance values can be manufactured. Besides these economic considerations, heating cables which have various resistance values are also subject to engineering restraints.

In order to achieve optimal adaptation to different requirements where heating cables are used, it would be desirable to use heating cables with a specific heating capacity, in other words, with a specific wattage per unit of length.

A cable of this type with such a specific heating capacity is known. In this known cable type two conductors running parallel and insulated from one another are jointly wrapped with electrically conducting strips having the requisite resistivity so that these resistance strips make alternate contact with the parallel conductors. By choosing the intervals between these points where the resistance strips make contact with the electrical conductor or conductors, it is thus possible to maintain a specific heating capacity. Since such a resistance strip makes contact with both parallel conductors, i.e., with both the phase wire as well as with the neutral wire, in the case, for example, of 220 volt alternating current, said heating cable must be surrounded by a relatively rigid and thick covering of electrical insulating material. Of necessity this results in very poor outward heat conduction, i.e. it leads to high heat buildup inside the cable structure and consequently to changes in resistance and to unstable conditions. Furthermore, such heating cables are very hard to bend because of the engineering design features required, and this in turn leads to considerable difficulties when the cables are laid. On the basis of its construction and the engineering design features required, this known heating cable not only has a very high materials cost but above all is also very expensive to manufacture.

SUMMARY OF THE INVENTION

The purpose of the present invention is to produce a heating cable with a specific heating capacity which is available at low cost, which has values that can easily be adapted to the most varied requirements, and which also ensures greater flexibility and better heat conduction.

According to the present invention an essentially coaxial heating cable is provided. In this novel cable, the inner conductor may consists of separate wires or of several twisted wires, or may be designed with an oval or elongated cross-section, i.e., in the shape of a ribbon. Alternate non-conducting and conducting separator discs are mounted on this inner conductor. In this arrangement each of the electrical conducting separator discs electrically connects the inner conductor with a coaxially mounted heating system and, passing through an insulating layer enclosing the heating system, each of the non-conducting separator discs connects the heating system to an electrically conducting outer casing. The dielectric, i.e., the insulating layer, in which the separator discs are embedded may be comprised of various materials such as polyethylene, elastomeric materials, ect. However, the insulating layer may also be air. When air is used as the dielectric, the heating system is composed of a braided covering of strips or foil or a cylindrical casing. In order for the non-conducting separator discs to ensure better contact between the heating system and the electrically conducting outer casing, their diameter is made somewhat larger than that of the conducting discs.

According to the invention, the conducting separator discs may simultaneously act as protective elements, for example, as fuses to protect against current and voltage surges. According to another feature of the invention, the separator discs are composed of materials which have temperature-dependent resistance values for the purpose of current limiting.

In place of the separator discs, the invention also provides that a continuous coil can be applied to the inner coaxial conductor. Obviously, the separator discs themselves or the coil may have the most varied open work or solid configurations, even with respect to outside diameter.

BRIEF DESCRIPTION OF THE DRAWING

Two preferred exemplary embodiments of the invention are explained below in greater detail with the aid of the attached drawings. Shown in the drawings are.

DESCRIPTION OF THE PREFERRED EMBODIMENTS

Figure 1:
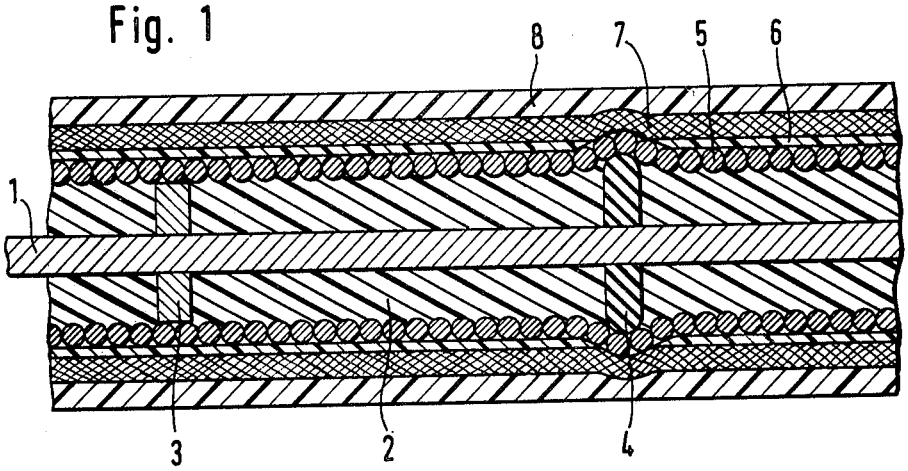
FIG. 1 longitudinal section through a heating cable.

FIG. 1 shows a longitudinal section through a heating cable according to the invention. The cable of FIG. 1 comprises the inner conductor 1, the conducting separator discs 3 and the non-conducting separator discs 4. The discs 3 and 4 are enveloped by the dielectric 2. The heating system 5 which in the disclosed embodiment comprises a coil of resistance wire, surrounds the dielectric 2 and the separator discs 3 and 4. At the sites of the non-conducting separator discs 4 the resistance wire 5 makes contact with the outer casing or the outer braided covering 7. The contact between the resistant wire coil 5 and the conductive covering 7 is made through the insulating layer 6 which surrounds the heating system 5. The heating cable, which has a specific heating capacity, is enclosed in a good heat-conducting material 8, which may, in addition, be adapted to specific requirements such as, for example, cold or abrasion resistance, good flexibility, mechanical strength, etc.

Figure 2:
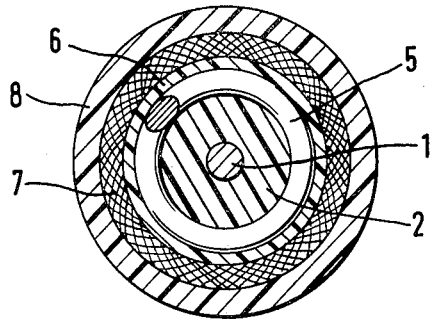
FIG. 2 cross-section of a coaxial heating cable.

FIG. 2 is a cross-sectional side elevation view of the heating cable of FIG. 1 and the same reference characters refer to like elements in FIGS. 1 and 2.

Figure 3:
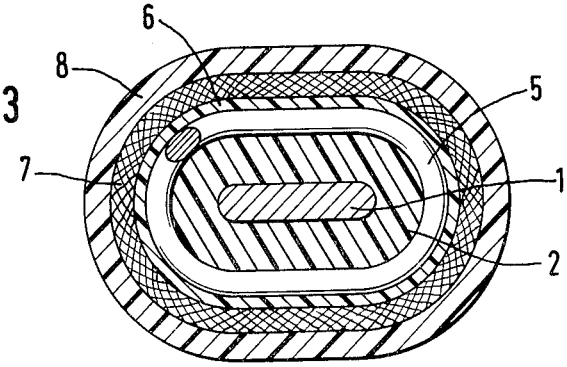
FIG. 3 cross-section of a heating cable of essentially coaxial design with, at each point, oval-shaped cross-sections.

FIG. 3 is a cross-sectional side elevation view of a heating cable which differs from that shown in FIGS. 1 and 2 only in that the inner conductor 1 is of a flat or ribbon-like configuration. This imparts an oval shape to the entire cable.

While the preferred embodiments have been shown and illustrated, various modifications and substitutions may be made thereto without departing from the spirit and scope of the invention. Accordingly, it is to be understood that the present invention has been described by way of illustration and not limitation.

What is claimed is:

1. An electric heating cable comprising:

inner electrical conductor means, said inner electrical conductor means having an axis;

a plurality of electrically conductive spacer means axially mounted on and in electrical contact with said inner electrical conductor means, each of said spacer means extending outwardly from said inner electrical conductor means and at least in part lying in a plane which is substantially perpendicular to the axis of said inner electrical conductor means at the point of said contact between said inner electrical conductor means and each of said conductive spacer means;

a plurality of electrically non-conductive spacer means axially mounted on said inner electrical conductor means, said non-conductive spacer means alternating with said conductive spacer means along said inner electrical conductive means, each of said non-conductive spacer means extending outwardly from said inner electrical conductor means and at least in part lying in a plane which is substantially perpendicular to the axis of said inner electrical conductor means at the point of contact between said inner electrical conductor means and each of said non-conductive spacer means, at least a portion of each of said non-conductive spacer means extending outwardly from said inner electrical conductor means a greater distance than the adjacent of said conductive spacer means;

electrically conductive heater means positioned coaxially of said inner electrical conductor means, said heater means being supported on said conductive and said non-conductive spacer means whereby current may flow between said inner electrical conductor means and said heater means via said conductive spacer means, said conductive and said non-conductive spacer means separating said heater means from said inner electrical conductor means;

electrically conductive casing means, said casing means being coaxial with said inner electrical conductor means and said heater means; and a first layer of insulating material separating said heater means and said casing means, electrical contact being established between said heater means and said casing means through said first insulating layer by pressure of said outwardly extended portions of said non-conductive spacer means on a portion of said electrical heating means.

2. Heating cable according to claim 1 characterized by the fact that in cross-section the structural components comprising the heating cable have an essentially elongated, oval shape.

3. The heating cable of claim 1 wherein said conductive and said non-conductive spacer means are of disc-shaped construction.

4. The heating cable of claim 1 wherein said conductive and said non-conductive spacer means are of disc-shaped construction.

5. The heating cable of claim 1 wherein said heater means comprises a coil of resistance wire, said coil of resistance wire being separated from said inner conductor means by a second layer of insulating material.

6. The heating cable of claim 1 wherein said heater means comprises an interwoven mesh of resistance wires.

7. The heating cable of claim 1 wherein said heater means and said inner conductor means are separated by a second layer of solid dielectric material and wherein said heater means is comprised of semi-conductive material supported on said second layer of insulating material.

8. The heating cable of claim 1 wherein said first layer of insulating material is a discontinuous solid material.

9. The heating cable of claim 1 wherein said casing means is defined by plural conductors.

10. The heating cable of claim 1 further comprising:

an outer covering of non-conductive material, said outer covering being in contact with said casing means and having a high thermal conductivity.

11. The heating cable of claim 1 wherein at least some of said conductive spacer means comprise fuse elements.

12. The heating cable of claim 1 wherein said conductive spacer means are formed from a material having a resistivity which varies with temperature.

* * * * *